United States Patent [19]

Nonini et al.

[11] Patent Number: 4,895,506

[45] Date of Patent: Jan. 23, 1990

[54] EXTRUSION PRESS

[75] Inventors: Geremia Nonini, Buttrio; Giampietro Benedetti, Campoformido, both of Italy

[73] Assignee: Danieli & C. Officine Meccaniche SpA, Buttrio, Italy

[21] Appl. No.: 168,884

[22] Filed: Mar. 3, 1988

[30] Foreign Application Priority Data

Dec. 2, 1987 [IT] Italy ..... 83505 A/87

[51] Int. Cl.[4] ..... B29C 47/54

[52] U.S. Cl. ..... 425/184; 264/39; 264/163; 425/192 R; 425/226; 425/302.1; 425/377

[58] Field of Search ..... 425/376.1, 377, 378.1, 425/190, 185, 192 R, 259, 184, 302.1, 311, 210, 225, 226; 264/148, 163, 151, 169, 39

[56] References Cited

U.S. PATENT DOCUMENTS

| | | | |
|---|---|---|---|
| 2,364,566 | 12/1944 | Stupakoff et al. | 425/192 R |
| 3,500,541 | 3/1970 | Hammerlund, Jr. et al. | 425/311 X |
| 3,897,184 | 7/1975 | Woodburn, Jr. et al. | 425/376.1 X |
| 3,898,831 | 8/1975 | Kahlefeld | 425/376.1 X |
| 4,083,666 | 4/1978 | Richardson | 425/192 R X |
| 4,128,371 | 12/1978 | Kopp | 425/192 R |
| 4,251,202 | 2/1981 | Asari et al. | 425/376.1 X |
| 4,565,512 | 1/1986 | Wills et al. | 425/190 |
| 4,626,189 | 12/1986 | Hammer et al. | 425/377 X |
| 4,642,039 | 2/1987 | Anders | 425/192 R X |
| 4,666,387 | 5/1987 | Yokota et al. | 425/192 R X |
| 4,731,006 | 3/1988 | Freda et al. | 425/190 |
| 4,737,092 | 4/1988 | Bullick | 425/376.1 X |

FOREIGN PATENT DOCUMENTS

| | | | |
|---|---|---|---|
| 132609 | 6/1986 | Japan | 425/225 |

*Primary Examiner*—Richard L. Chiesa
*Attorney, Agent, or Firm*—Wegner & Bretschneider

[57] ABSTRACT

A direct or indirect extrusion press is disclosed, which includes a container (20) that defines a chamber (19) to hold a billet (11) to be extruded, a ram (12), a die (14), a die holder (41), a base (13) and a shears (15) to shear heels (17) of the billets (11). The die (14) is movable axially to the container (20) or vice versa. The container (20) defines at least two chambers (19) and is movable in a plane perpendicular to the plane on which the axis of the chamber (19) and the die (14) lies. An extrusion plant which includes a press as described above is also disclosed. The extrusion plant includes three stations that perform extrusion (19*a*), charging (19*b*) and the cleaning and readying of chambers (19*c*) respectively, the stations cooperating respectively with the chambers (19).

5 Claims, 4 Drawing Sheets

EXTRUSION PRESS

This invention concerns improvements to extrusion presses and also the extrusion presses which employ such improvements and are therefore thus improved.

To be more exact, the invention can be applied either to direct extrusion presses or indirect extrusion presses.

Extrusion means here the plastic deformation of a metallic billet passed through an appropriate die, the extrusion being carried out by a ram or by the die, depending on the type of extrusion.

Direct extrusion presses are known and are those in which the metal deformed by the thrust of a ram while passing through a die emerges in the direction of forward movement of the ram.

Indirect extrusion presses are also known and are those in which the metal emerges in the opposite direction to the forward movement of the die.

In the known systems of direct (FIG. 1) and indirect (FIG. 2) extrusion shown diagrammatically in the figures cited above and attached hereto for the purposes of clarification, it is necessary to arrange thereafter not only for an express and specific step of shearing the heel of the billet (FIGS. 1d and 3c) but also for a specific step of withdrawing the ram (FIGS. 1*a* and 2*a*) so as to enable a new billet to be introduced for extrusion.

The withdrawal of the ram has to be such as will enable the new billet to be moved crosswise onto the axis of the extrusion chamber.

The operations of shearing the heel of the previous billet, withdrawing the ram and introducing the new billet entail additional, considerable, non-productive times due to the stoppage and therefore a heavy operating cost.

Moreover, as the ram itself has to position the billet first and then to extrude it in the state of the art, it is necessary, after the step of positioning and beginning to extrude the billet, to halt the thrust action momentarily, withdraw the ram to let out the air and then to restart the extrusion.

This operation too is necessary in the state of the art and entails not indifferent downtimes and waste.

The invention tends to eliminate the downtimes cited above and to obtain limited times for changing the billet and shearing its heel, thus enabling a high rate of output to be achieved.

According to the invention the container can move sideways and comprises at least two containment chambers having their axes parallel; a shears is provided which is suitable to shear any remaining heel of a billet in the direction of sideways movement of the container. The productive working cycle is substantially exactly the same as with traditional presses.

According to the present invention, however, while one chamber is undergoing the extrusion step, the other chamber is being cleaned, readied and charged with the next billet.

Moreover, as the latter chamber is charged separately, the problem of withdrawal of the ram for expulsion of air does not arise.

In a variant, in which three chambers are provided at equal distances apart on a circumference and can rotate on the axis of that circumference, the thrid chamber downstream of the extrusion position is employed for cleaning work, so that in the next position of introduction of a billet the containment chamber has already been cleaned and is ready to accept the billet.

According to the invention, while the chamber is being moved from one position to another, the shears in cooperation with the die performs the shearing of the heel, which is free to drop independently.

If the container comprises only two chambers and is therefore capable of a sideways to-and-fro movement, the shears may have two blades, one of which can work in one direction while the other can work in the other direction, the shears forming one single body together with the container of the chambers.

According to a variant, while the chambers are being transferred from one working position to another, the container body comprising the chambers withdraws and a shears cooperates with the die in shearing the heel of the billet.

The invention is therefore obtained with improvements to extrusion presses, whether the presses perform direct or indirect extrusion.

The invention is also embodied with extrusion presses, whether they perform direct or indirect extrusion, which employ the improvements cited above.

BRIEF DESCRIPTION OF THE DRAWINGS

The attached figures, which are given as a non-restrictive example, show the following:

FIGS. 5 to 9 show a variant of the invention.

DETAILED DESCRIPTION OF THE PREFERRED EMBODIMENTS

FIGS. 1 to 4 give rough diagrams since the practical application to individual extrusion presses is a design problem.

Figure 1:
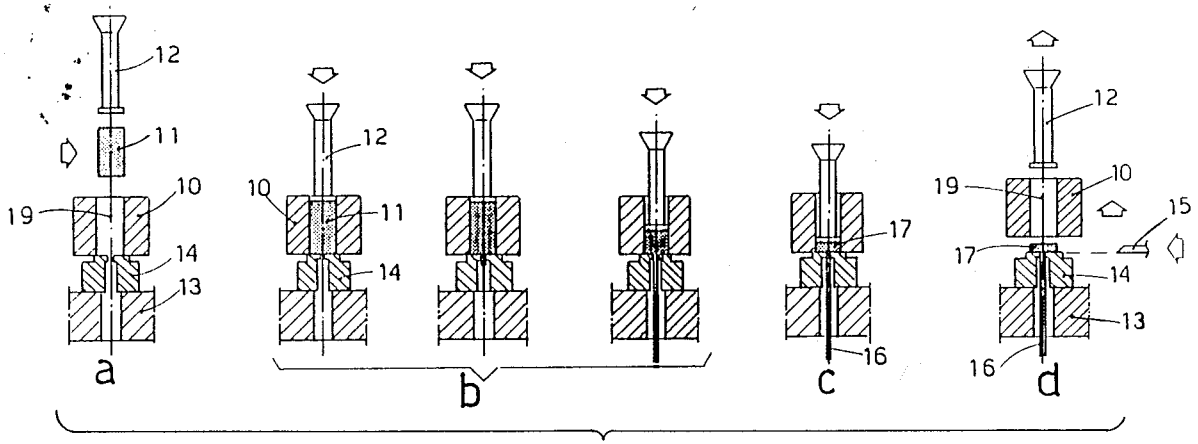
FIG. 1 PRIOR ART
FIGS. 1*a*–1*d* and 2*a*–2*c* give diagrams of the various working steps of the state of the art.
Figure 2:
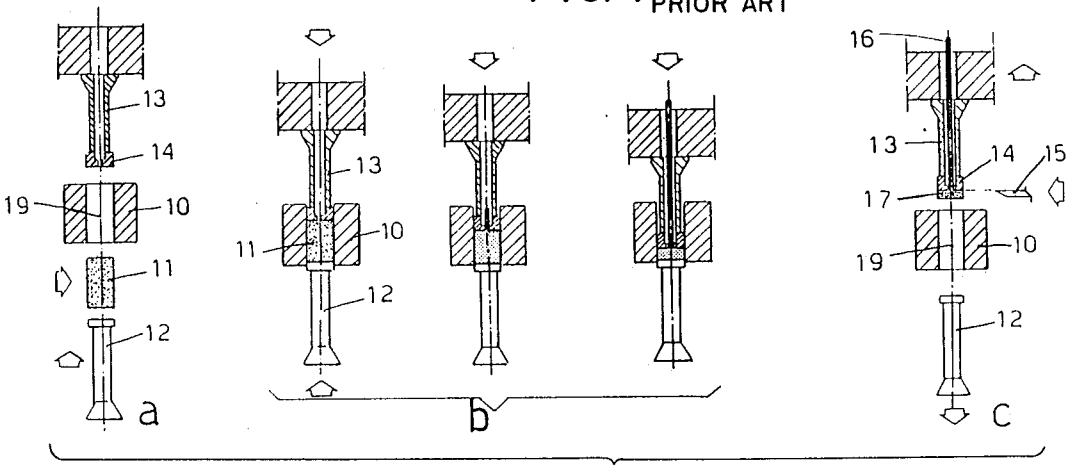
FIG. 2 PRIOR ART
Figure 3B:
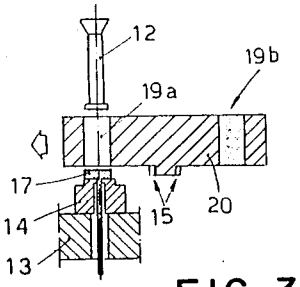
FIGS. 3*a*, 3*b*, 4*a* and 4*b* show the art as innovated with the improvements according to the invention.

For the sake of simplicity, FIGS. 1 and 2 and the other figures show the extrusion of solid sections, but are applicable correctly to complex and/or bored sections as well.

FIG. 1 gives the various steps performed by an extrusion press with a direct cycle. The first step 1*a* provides for introduction of a billet 11 into a chamber 19 after a considerable axial withdrawal of a ram 12 so as to leave the necessary space for the sideways approach of the billet 11 to take up a position along the axis of the chamber 19.

When the billet 11 has been inserted into the chamber 19 of a container 10 (FIG. 1*b*), the ram 12 is advanced and starts exerting its thrust, so that the material begins being extruded through a die 14, after which the ram 12 withdraws to let air out and then starts the actual extrusion step.

When the ram 12 has ended its travel (FIG. 1*c*), a heel 17 of the billet forms within the container 10 and, to be eliminated, has to be sheared from the extruded product 16 by a shears 15.

The shears 15 performs the shearing of the heel 17 after the ram 12 and container 10 or base 13 (FIG. 1*d*) have been distanced from the heel.

Instead, in the event of indirect extrusion (FIG. 2) the procedure is substantially analogous since the ram 12 has to withdraw considerably (FIG. 2*a*) to enable the billet 11 to be introduced into the chamber 19.

When the extrusion operations shown in FIGS. 2*b* have been carried out, a bond is formed between the extruded product 16 and its heel 17, which is produced in this case too.

The heel 17 has to be sheared (FIG. 2*c*) by an appropriate shears 15, which sunders it from the extruded product 16 after the die 14 has been moved away.

After this operation the chamber 19 has to be cleaned and readied, and then a new billet 11 is inserted therein.

As can also be seen just from the diagrams used to show the working cycle of the direct or indirect extrusion presses, the state of the art entails long downtimes due to the shearing (positions 1*d* and 2*c*), to the introduction of the billet (positions 1*a* and 2*a*) and to the auxiliary operations and also involves an initial waste of time.

As we said earlier, such waste of time is considerable in view of the slow movement of the ram, which cannot be displaced quickly and therefore causes very long times for its withdrawal and approach. These times are not reduced by the inclusion of traditional means to charge the billets.

The invention eliminates these downtimes by providing an improved container 2 which can move at least sideways and possibly axially as well. Such container 20 (FIGS. 3 and 4) provides at least two chambers 19*a* and 19*b* respectively in which a billet 11 is lodged correctly.

According to a variant the container 20 may include three or more chamber 19 and be able to rotate step by step about an axis of rotation 21.

In such a case each position of the chamber 19 will comprise its own specialized equipment directly correlated with its momentary working function.

According to the invention, while the first chamber 19*a* is in its working phase, that is to say, while the billet 11 held in the chamber 19*a* is thrust by the ram 12 and the material is extruded along the extrusion axis 39 through the die 14, the second chamber 19*b* is free for cleaning and readying and for introduction of the next billet 11, the operation of introduction of such billet 11 being assisted by a charging means 29.

If the container 20 comprises three chambers 19 arranged, for instance, circumferentially about the axis of rotation 21, the third chamber 19*c* undergoes a cleaning and readying operation performed, for instance, by a cleaning means 30 while the other chambers 19*a* and 19*b* respectively performing the extrusion and charging carry out the specific tasks described.

In this way a plant to accompany the press is obtained in which the whole cycle can be automated and the operator's task becomes an auxiliary control function.

A charging means 29 may include a traversing carriage 35 positioned by a rapid displacement jack 36, on which is fitted a charging jack 34 that thrusts the billet 11 into the chamber 19 in its position 19*b*.

The cleaning means 30 comprises a cleaning tool 33, which may also be capable of rotary movement and be actuated axially by a cleaning jack 32 that cooperates with the axis of the chamber 19 in its position 19*c*. The cleaning means 30 may act in the opposite direction to the direction of extrusion.

The charging means 29 too may work in the same direction as, or in the opposite direction to, the direction of extrusion.

The invention arranges that during the extrusion step at least two clamping jacks 34 actuate clamping wedges 23 with recessed brake shoes that act very close to the periphery of the chamber 19. The inclusion of the wedges 23 and the action of the clamping jacks 24 enable the clamping action to be restored continuously and to be kept very near to the periphery of the billet being extruded.

This arrangement, which becomes possible owing to the special nature of the invention, enables lateral extrusions, which take place in the state of the art owing to the bending of the stiffening arms, to be avoided.

The chamber 19 may comprise circumferential heated chamber 28 which serve to keep the chambers 19 at the required temperature. These heated chamber 28 may be heated with resistors which, in the case of a container 20 able to rotate in one single direction 40, are fed by a ring-type distributor.

When the extrusion step in the first chamber 19*a* has been carried out, the container 20 passes from a working position 37 to a transfer position 38 and is removed from the die 14 by a required distance.

In the situation of FIGS. 3 and 4 the blades 15, which in the case shown are suitable to work in both directions of movement of the container 20 and protrude from the container at least momentarily, namely at least during the displacement and shearing step, pass in the neighbourhood of the die 14 and shear the heel 17.

This enables the extruded product 16 to be discharged directly by extrusion of the next billet 11 already positioned in the chamber 19*b*.

A variant provides for the container 20 to be able to move only in a transverse direction, whereas the die 14 withdraws axially by a distance such as will enable the blades 15 passing by to shear the heel 17 at its base.

Figure 4B:
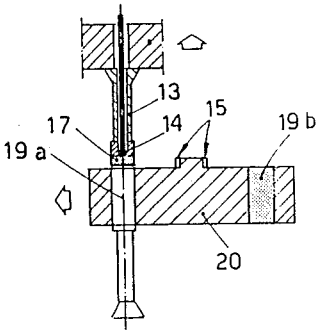
Figure 3A:
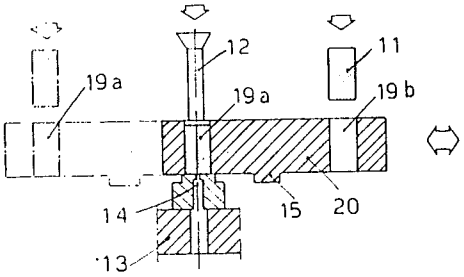
Figure 4A:
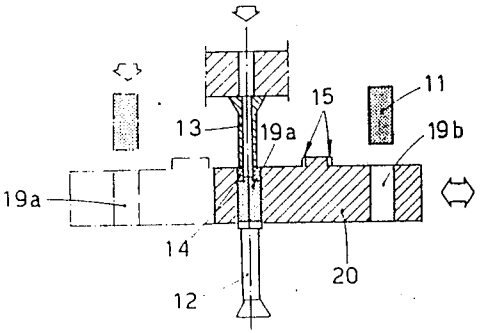
Figure 5:
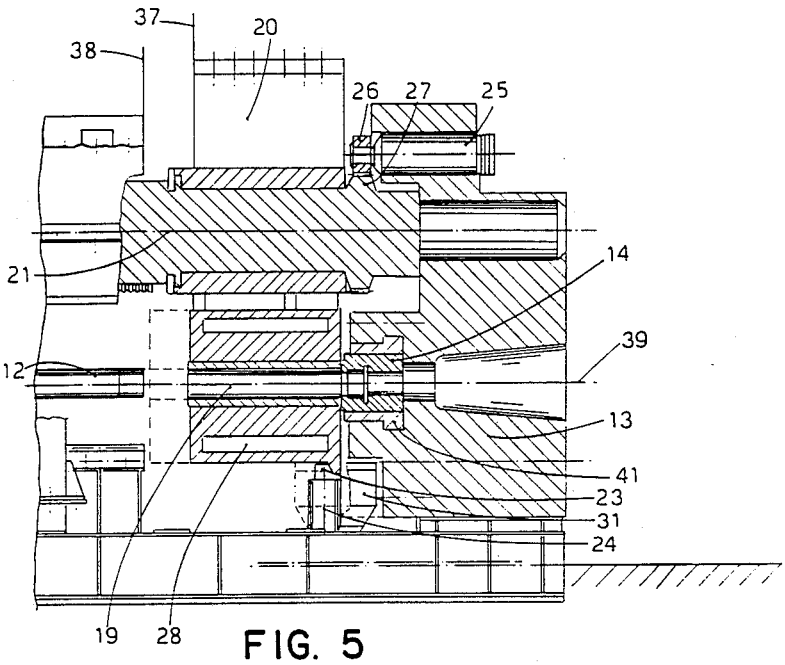
Figure 6:
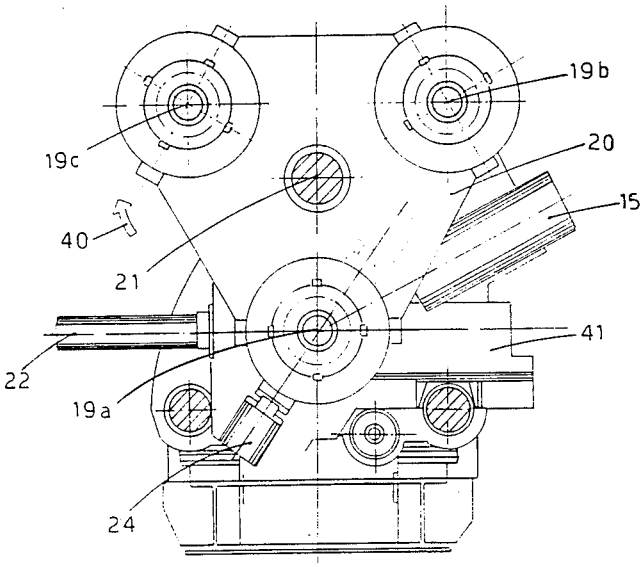

The cycle is substantially the same whether the extrusion is direct (FIGS. 3*a*–3*b*) or indirect (FIGS. 4*a*–4*b*).

According to the invention the only non-operational displacements are therefore a minimum reciprocal distancing of the container 20 and die 14 to enable the heel 17 to emerge fully from the chamber 19*a* and a sideways or rotary displacement of the container 20.

In the embodiment of the variant shown in FIGS. 5 to 9 the container 20 is displaced axially by a displacement jack 18.

When the container is in the transfer position 38, the shears 15 advances and shears the heel 17 protruding from the die 14.

A means 31 to discharge the heel 17 may be included in cooperation with the shears 15.

Rotation of the container 20 is obtained by the action of a motor 25, which acts by means of a pinion 26 on a gear wheel 27 coaxial with the axis of rotation 21 and solidly fixed to the container 20.

The die 14 is held by a die holder 41, which is capable of being moved by a die-change jack 22 to make possible an easy replacement of the die 14.

According to the invention, therefore, the working times required for replacements and repairs are very short and, whether the extrusion is direct or indirect, enable the efficiency of the working cycles per unit of time to be increased considerably.

We claim:

1. A press device for carrying out extrusion of a metal billet, said press device comprising:

a container, said container having a plurality of chambers formed therein for holding billets, each of said chambers having a central longitudinal axis:

an extrusion ram;

a die secured to a die holder, said die and said container being axially movable with respect to each other;

a shears to shear a heel of the billet, said shears being secured to the die holder and disposed between the die and said container;

wherein said chambers are rotatable about an axis parallel to and equidistant from the central longitudinal axes of said chambers in order to present each of said chambers sequentially to said extrusion ram and die so that while an active chamber is undergoing the extrusion step, the other chamber or chambers can be presented to other operating positions, said die and die holder forming an exit aperture for the extruded billet, and wherein the shears shear the heel of an extruded metal billet as the active chamber container the most recently extruded billet is moved from one position to another.

2. A device as in claim 1, further comprising recessed clamping wedges actuatable by clamping jacks during the extrusion process, said wedges being disposed on said container adjacent the periphery of said exit aperture.

3. A device as in claim 1, wherein said chambers are rotatable to present each of said chambers sequentially to an extrusion station including said extrusion ram and die, a charging station, and a cleaning and readying station.

4. A device as in claim 3, wherein said charging station includes a charging means having at least one jack for thrusting the billet into the chamber presented at said charging station.

5. A device as in claim 3, wherein said cleaning and readying station includes a cleaning means having a cleaning tool disposed at the front end thereof, said cleaning tool being movable along the axis of the chamber presented at said cleaning and readying station.

* * * * *